US006015243A

United States Patent [19]

Geiger

[11] Patent Number: 6,015,243

[45] Date of Patent: Jan. 18, 2000

[54] CONCRETE MATERIAL PAVING STONE

[76] Inventor: Peter Geiger, Regensburger Strasse 160, Neumarkt, Germany, D-92318

[21] Appl. No.: 09/142,436

[22] PCT Filed: Jan. 8, 1997

[86] PCT No.: PCT/EP97/00041

§ 371 Date: Sep. 8, 1998

§ 102(e) Date: Sep. 8, 1998

[87] PCT Pub. No.: WO98/30754

PCT Pub. Date: Jul. 16, 1998

[51] Int. Cl.[7] ..... E01C 5/06

[52] U.S. Cl. ..... 404/38; 404/34; 404/37; 404/41

[58] Field of Search ..... 404/34, 37, 38, 404/41, 42

[56] References Cited

U.S. PATENT DOCUMENTS

| | | | |
|---|---|---|---|
| Re. 3,208 | 11/1868 | McKensie | 404/37 |
| 4,496,266 | 1/1985 | Ruckstahl | 404/41 |
| 4,497,858 | 2/1985 | DuPont et al. | 404/41 |
| 5,133,620 | 7/1992 | Scheiwiller | 404/37 |
| 5,503,498 | 4/1996 | Scheiwiller | 404/34 |

FOREIGN PATENT DOCUMENTS

| | | |
|---|---|---|
| WO94/25677 | 4/1994 | Germany . |

*Primary Examiner*—Thomas B. Will
*Assistant Examiner*—Raymond W Addie
*Attorney, Agent, or Firm*—Collard & Roe, PC

[57] ABSTRACT

A paving stone, made from concrete material, having a one-piece plane surface and two strip like support attachments arranged on each lateral surface. These support attachments form joints between adjacent paving stones in a laid composite structure. On each side, two support attachments are symmetrically arranged with center spacings relative to the planes of symmetry, wherein these planes of symmetry extend through the centers of adjacent lateral surfaces. When these paving stones are stacked next to each other, the support attachments from a first paving stone is disposed adjacent to a support attachment on an adjacent paving stone.

4 Claims, 7 Drawing Sheets

CONCRETE MATERIAL PAVING STONE

BACKGROUND OF THE INVENTION

FIELD OF THE INVENTION

The invention relates to a paving stone made from Concrete material, with a one-piece plane surface and two strip-like support attachments arranged vertically on each lateral surface, said support attachments forming joints between adjacent paving stones in the laid composite structure.

SUMMARY OF THE INVENTION

In connection with known paving stones of the type specified above, the support attachments rest against the lateral surfaces of adjacent paving stones when the latter are laid, forming spacing joints according to the association and design of the support attachments. The laying operations for installing such paving stones present problems in this connection because unintended shifting of the paving stones occurs in the composite structure parallel with the laying plane especially when laying is carried out with machines, causing the laying result to be uncertain and the laying pattern to be nonuniform and unclear. Furthermore, displacements of the paving stones require finishing work operations, which are found to be costly in terms of time and labor.

The problem of the invention is to create measures for avoiding unintended shifting parallel, with the laying plane when installing paving stones made from concrete material; for facilitating the laying operation; and for achieving safe retention of the joints.

Said problem is solved according to the invention in that two support attachments are symmetrically arranged on two adjacent lateral surfaces of the body of the paving stone with axis of symmetry s1 and s2, respectively, extending through the centers of the adjacent lateral surfaces with center spacings a' and a', respectively, relative to the axis, said support attachments having a thickness "b" and a width "c"; that on each of the lateral surfaces opposing each other, two support attachments are formed with a center spacing d' and, respectively, d', said attachments being symmetrically displaced in the direction of the associated corner areas and substantially having a thickness "b/2" and a width "c"; and that the support attachments having thickness "b" are, when the stones are laid in a cross-type composite structure, insertable between the support attachments designed with thickness "b/2" depending on the association of the lateral surfaces, or, when the stones are laid in a stretcher-type composite, are insertable between attachments with thickness b/2 and grip over support attachments with thickness b/2 in the manner of clamps. The formation of attachments with different thicknesses on the lateral surfaces of the paving stone facilitates the manual or mechanical installation due to displacement-free coherence arid engagement of the paving stones and laying of the latter in cross bond and stretcher-type configurations. Furthermore, the different thicknesses of the support attachments lead to exact laying patterns and their retention even if the composite pavement is subjected to high loads, for example motor vehicles driving thereon, etc. For forming the paving stone provision is made that the cross-sectional design of the paving stones is parallelogram-shaped, for example rectangular or in the form of a broad stone. Preferred are both types of support attachment, however, with a cross section designed in the form of a trapeze with equal legs, and with dimensions such that the support attachments have head areas with the same width "c" as well as a thickness "b" or "b/2", and lateral surfaces with the same angles of inclination "alpha" relative to the lateral surfaces of the body of the paving stone, said lateral surfaces of the attachments extending with increasing width toward the foot areas. A largely exact fit and play-free support of the paving stones in achievable in this way in the composite structure because the conicity of the support attachments promotes their fit to each other and contributes to shift-free lating. According to a further development of the invention, provision is made that paving stones are realizable with rectangularly shaped paving stone bodies, the latter having dimensions of 210×130 mm, or with dimensions of 172×172 mm for square paving stone bodies. Furthermore, provision is made for dimensions of 240×160 mm as a mosaic measure for rectangular paving stones, whereas 200×200 mm was found to be an advantageous mosaic measure for paving stones with square bodies.

In further development of the paving stone, provision is made, furthermore, that on two adjacent lateral surfaces of the paving stone body, two support attachments are symmetrically arranged with spacings A' and A' relative to lines S1 and, respectively, S2 extending through the center of each of the adjacent lateral surfaces; that said support attachments are designed with a thickness "B" and a width "C"; and that the lateral surfaces opposing each other in each case have two support attachments with thickness "B/2" and width "C", said support attachments having a spacing between each other corresponding with thickness "C" and being displaced toward to corner area with a common spacing "H" and, respectively, "H'", thereby forming a receiving groove for an attachment designed with thickness "B". In this way, when paving stones are laid in stretcher-type and cross-bond composite patterns, the support attachments with thickness "B" can find support on lateral surfaces of the paving stone body of adjacent paving stones and one of said support attachments can in each case engage the space between the two support attachments with thickness "B/2", acting as a spring element. In this embodiment, too, the support attachments can be selectively designed with parallelogram-shaped cross sections, or an the trapezoidal form, and they can be dimensioned in such a way that both types of support attachment have head surfaces with the same width "C" as well as with a thickness "B" or "B/2", and lateral surfaces having the same angle of inclination "alpha" versus the lateral surfaces of the body of the paving stone, whereby the support elements extend with increasing width toward the foot area. Furthermore, the rectangularly shaped paving stone bodies are designed with the dimensions 210×130 mm, and the square paving stone bodies with the dimensions 172×172 mm, whereby the mosaic measure of paving stones with rectangular bodies amounts to approximately 240×160 mm, and the one of the square paving stone body comes to 200×200 mm.

It is understood that dimensional deviations assuring retention of the functions of the paving; stones are covered by the invention.

BRIEF DESCRIPTION OF THE DRAWINGS

Exemplifies embodiments with the features essential to the invention are shown in the drawing and illustrate how the invention is realizable. In the drawings.

DETAILED DESCRIPTION OF THE PREFERRED EMBODIMENT

Figure 1:
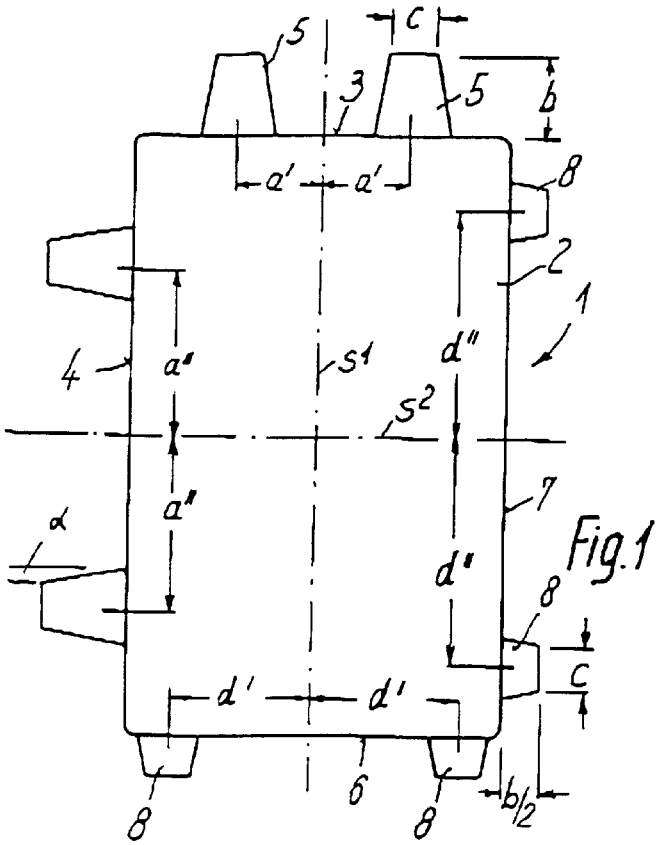
FIG. 1 shows a top view of a paving stone with a rectangular shape.
Figure 3:
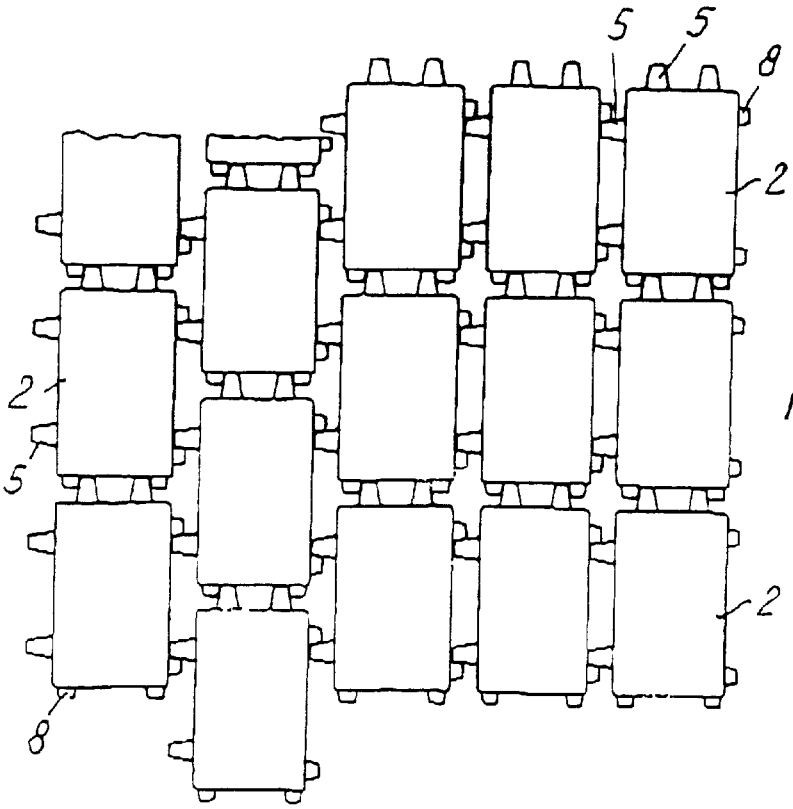
FIG. 3 shows a laying pattern with paving stones partly in a cross and partly in a stretcher-type configuration.
Figure 2:
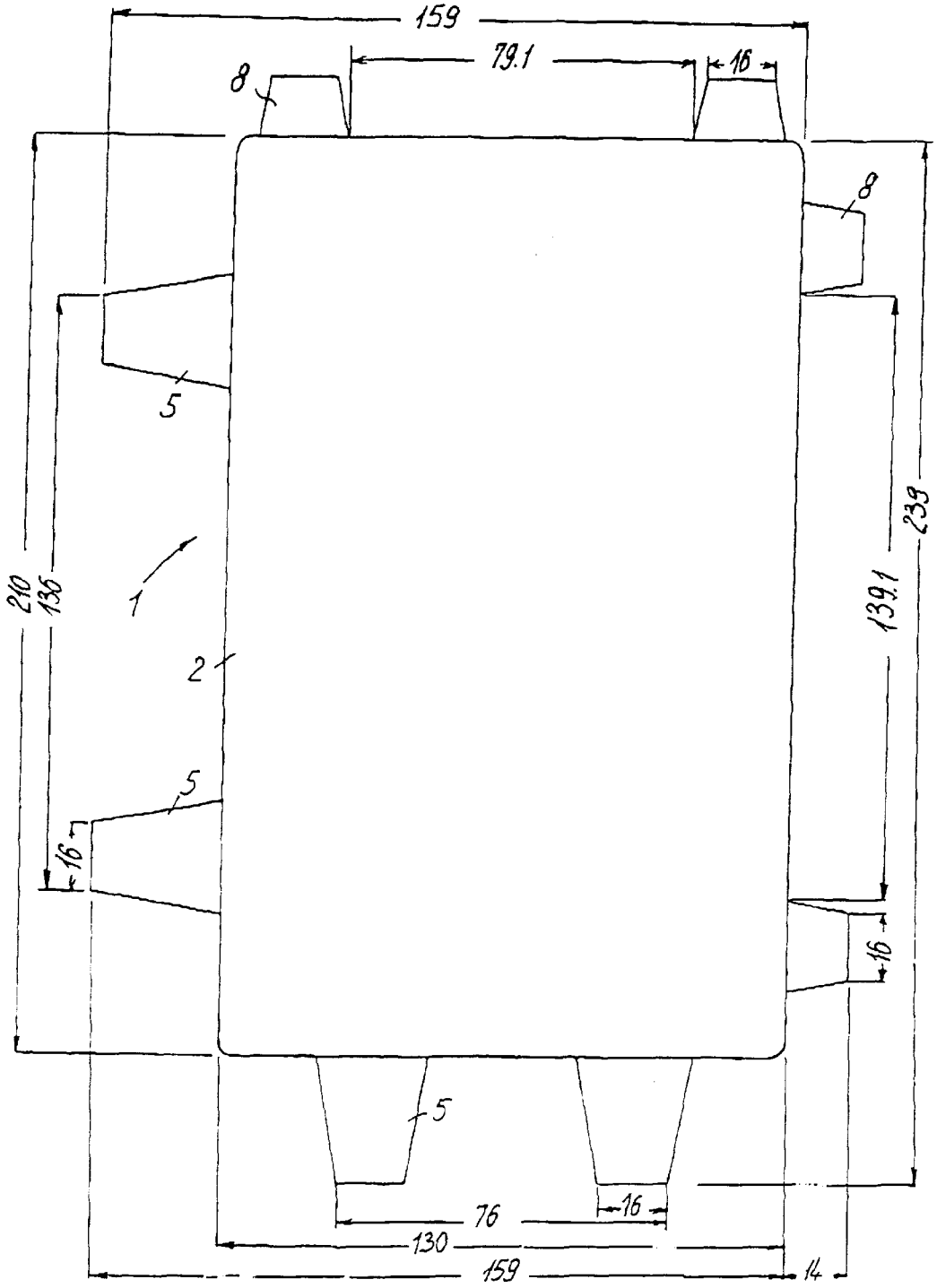
FIG. 2 shows a top view of a paving stone according to FIG. 1 with a rectangular shape by an enlarged view with dimensional data.

FIGS. 1 to 3 show a paving stone 1 with a rectangular paving stone body 2, which has the support attachments 5 on lateral surfaces 3 and 4. Support attachments 5 are arranged symmetrically with center spacings a' and a", respectively, relative to symmetry planes s1 and s2, and designed with a thickness "b" and a width "c". Furthermore, they are designed with a trapezoidal shape with equal legs with angle of inclination "alpha" of their lateral surfaces relative to the, lateral surfaces 3 and 4 of paving stone body 2. On lateral surfaces 6, 7 of paving stone body 2, support attachments 8 are symmetrically arranged with Center spacings d' and d", respectively, relative to symmetry planes s1 and 2, respectively. Support attachments 8 are designed with thickness "b/2" and width "c". Furthermore, spacings "d"' and "d'd" are select in such a way that the two support attachments 5 are jointly and simultaneously insertable in the space between support attachments 8 in order to achieve through support of the lateral surfaces displacement-free laying of the paving stone in the composite structure. The symbols used for the paving stone according to FIGS. 1 to 3 substantially denote the following dimensions:

a'=30 mm a'=60 mm d1=50 mm d'=70 mm b=30 mm b/2=15 mm c=16 mm alpha=15 degrees.

Figure 15:
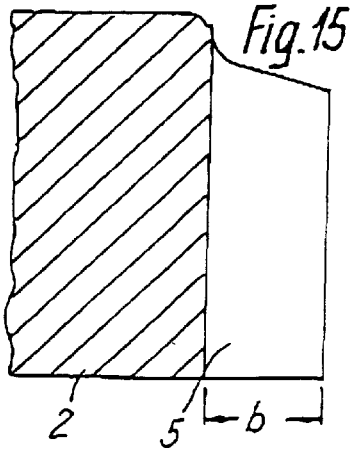
FIG. 15 is a section according to line XV—XV in FIG. 4.
Figure 16:
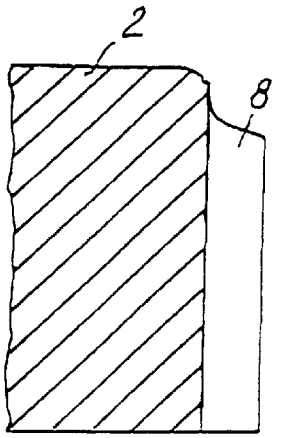
FIG. 16 is a section according to line XVI—XVI in FIG. 4.

FIG. 2 shows the paving stone of FIG. 1 with additional dimensional data. Support attachments 5 and 8 extend over part heights of paving stone 1 as shown in FIGS. 15, 16.

Figure 5:
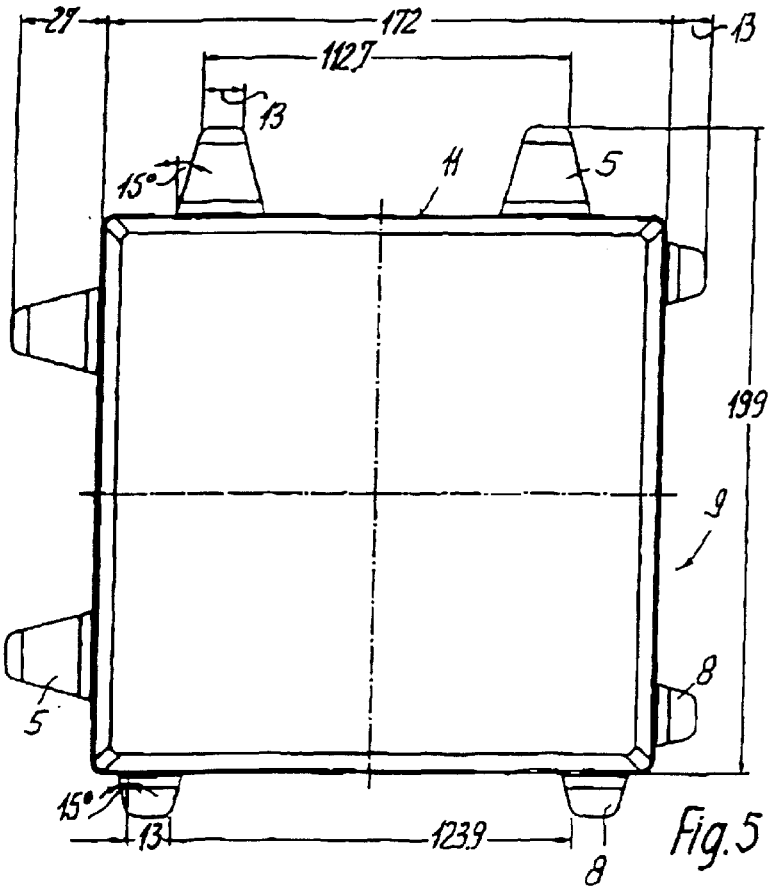
FIG. 5 shows a top view of a paving stone with a square shape and includes dimensional data.
Figure 4:
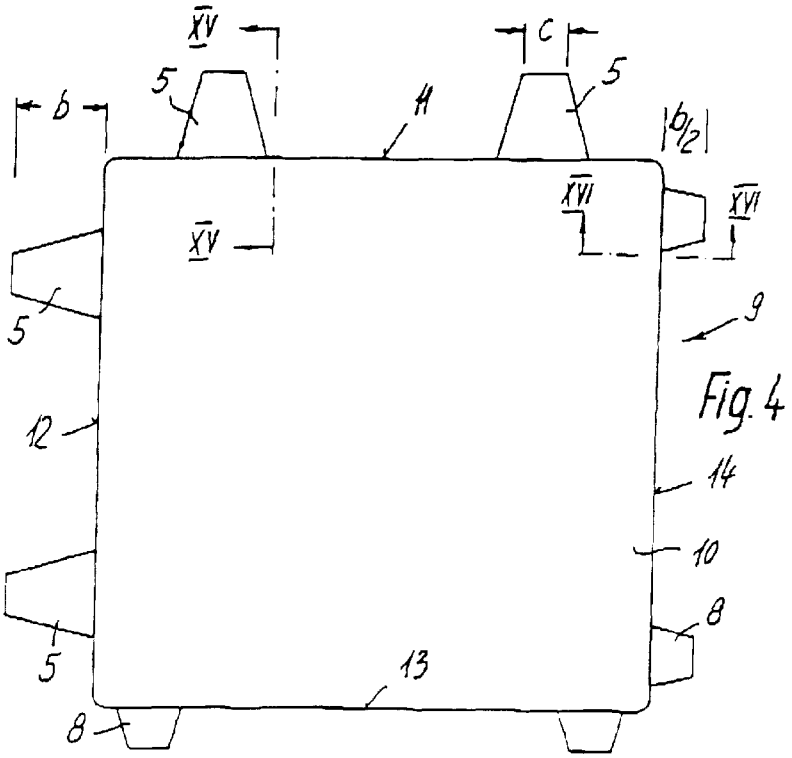
FIG. 4 shows a top view of a paving stone with a square shape.
Figure 7:
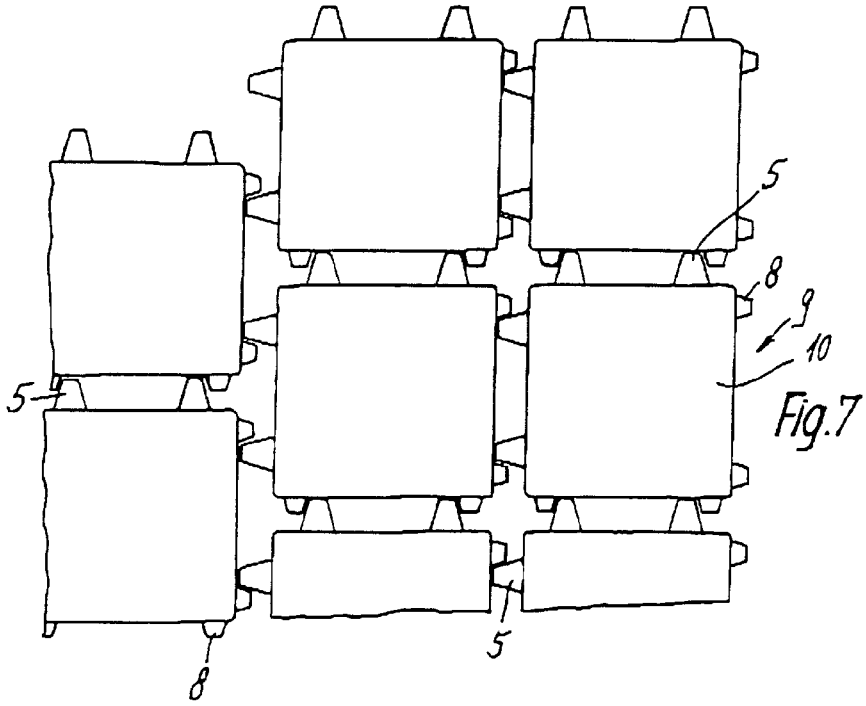
FIG. 7 shows a laying pattern with paving stones partly laid in a cross and partly in a stretcher-type configuration.
Figure 6:
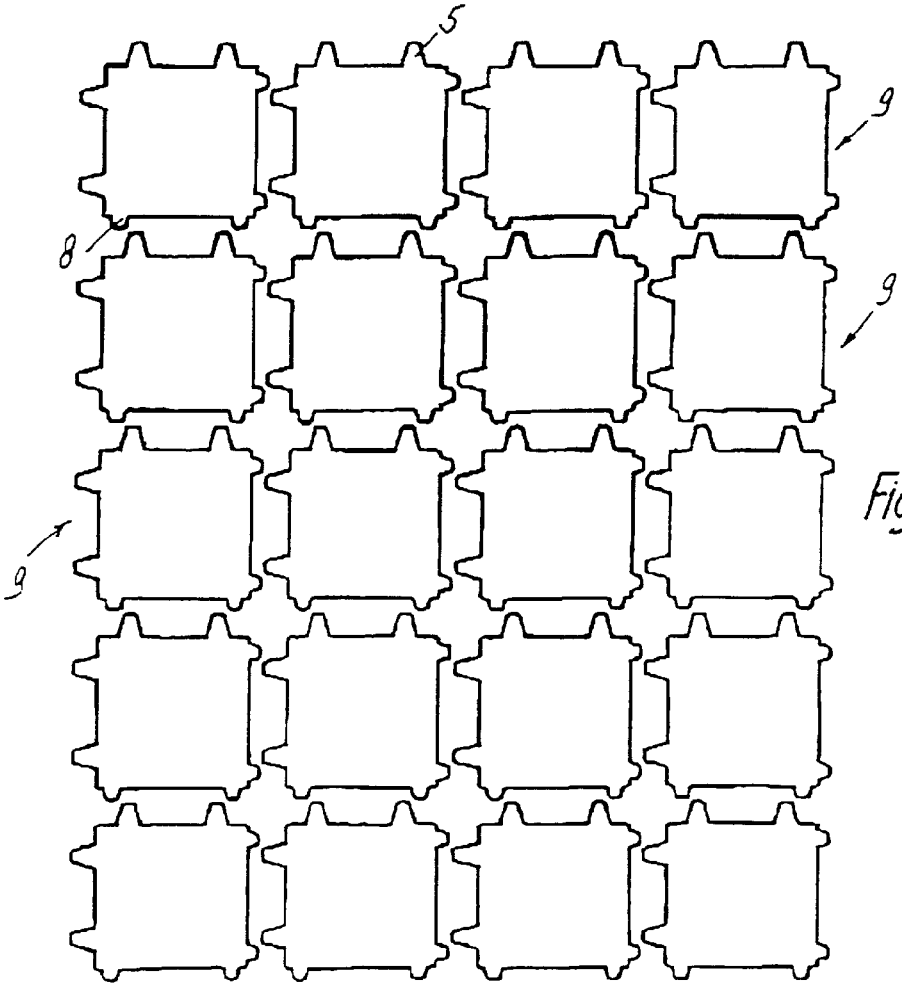
FIG. 6 shows a laying pattern for paving stones according to FIG. 4 by a reduced top view.

FIGS. 4 to 7 show a modified embodiment of a paving stone 9 with a square-shaped paving stone body 10. While paving stone 9 is shown in FIG. 4 schematically, paving stone 9 is shown in FIG. 5 in its natural form with dimensional data. With paving stone 9 according to FIGS. 4 to 7, two trapezoidal support attachments 5 with thickness "b" and width "c" are used on each of the lateral surfaces 11 and 12, and two support attachments 3 with thickness "b/2" and width "c" on each of the lateral surfaces 13 and 14. The spacings of support attachments 5 and support attachments 8 on lateral surfaces 11, 12 and, respectively, 13, 14, are selected in such a way that in the composite structure as shown in FIG. 7, attachments 5 each engage the space between adjacent support attachments Bor grip over two adjacent support attachments, thereby preventing displacements of paving stones 9 parallel with the laying plane. FIG. 6 shows a multitude of paving stones 9 which, after having been pushed together, can be mechanically seized and laid as a composite structure. Laying takes place here in a cross-type composite pattern.

Figure 8:
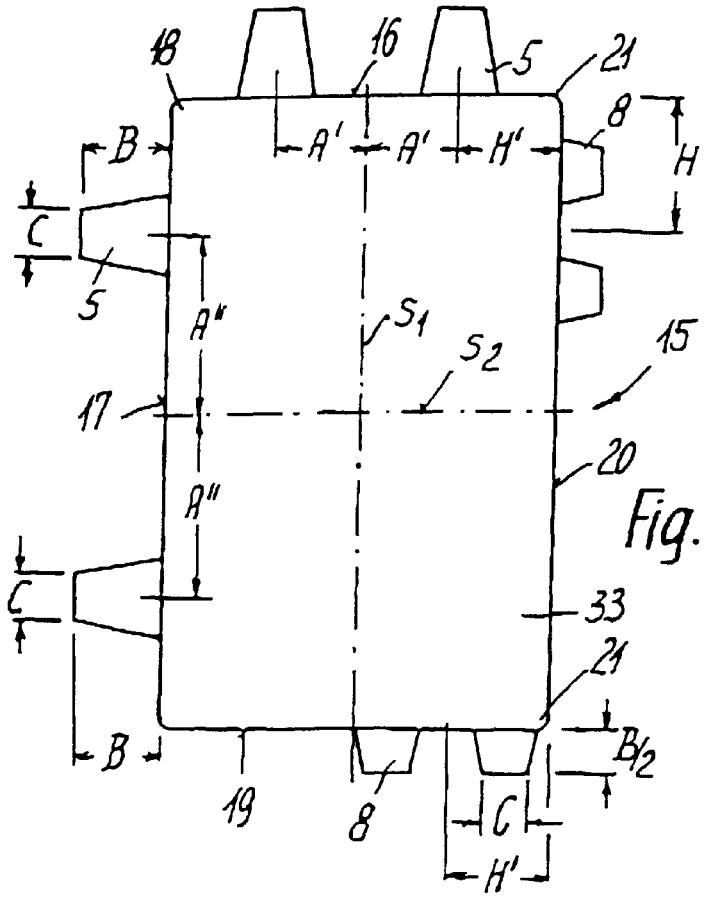
FIG. 8 shows a top view of a paving store with a rectangular design according to a modified embodiment.
Figure 9:
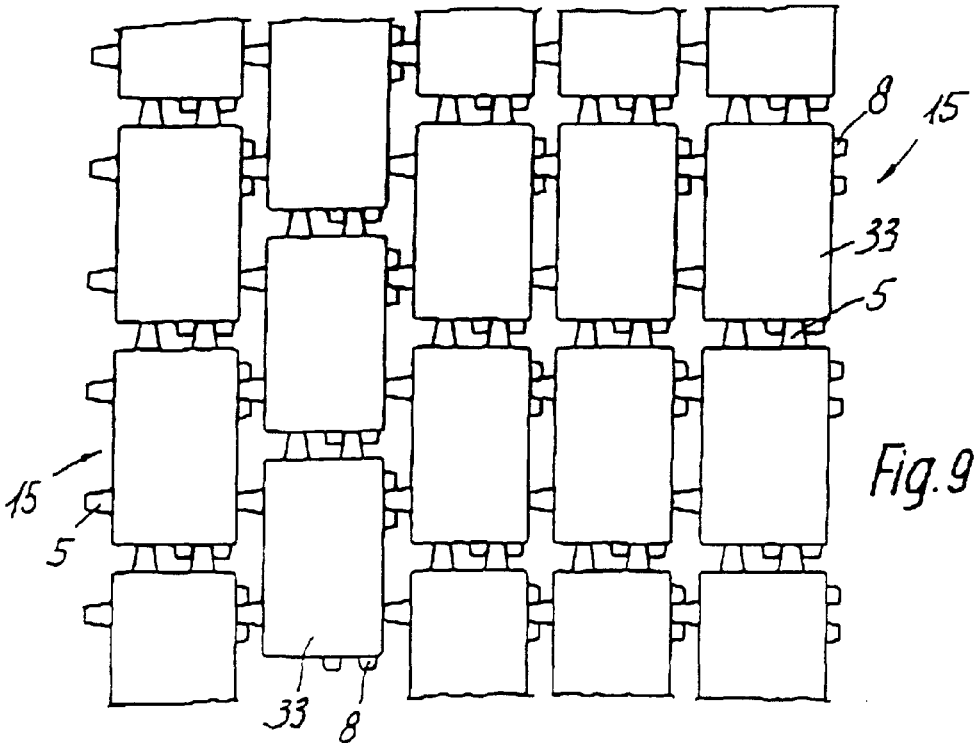
FIG. 9 shows a laying pattern with paving stones according to FIG. 8, with a partly cross-type and a partly stretcher-type configuration.

FIGS. 8 and 9 show a paving stone 15 with a rectangular paving stone body 33. Lateral surfaces 16, 17 of the latter have support attachments 5 in the trapezoidal form with center spacings A' and A', respectively, symmetrically relative to lines si and s2, respectively, and with thickness "B" and width "C", as well as support attachments 8 on lateral surfaces 19 and 20, said support attachments being arranged with a spacing next to each other and displaced relative to corner areas 21 with center spacings H and H'. Such displacement is selected here in such a way that in the composite structure, one of each two support attachments 5 of lateral surfaces 16, 17 engages the intermediate space of two attachments 8, whereas the other attachment 5 is freely in contact with lateral surfaces of the paving stone body of an identical paving stone to form a displacement-free composite structure. In FIG. 9, laying of paving stone 15 is shown on the right-hand side in a cross-like pattern, and on the left-hand side in a stretcher-type laying pattern.

Figure 10:
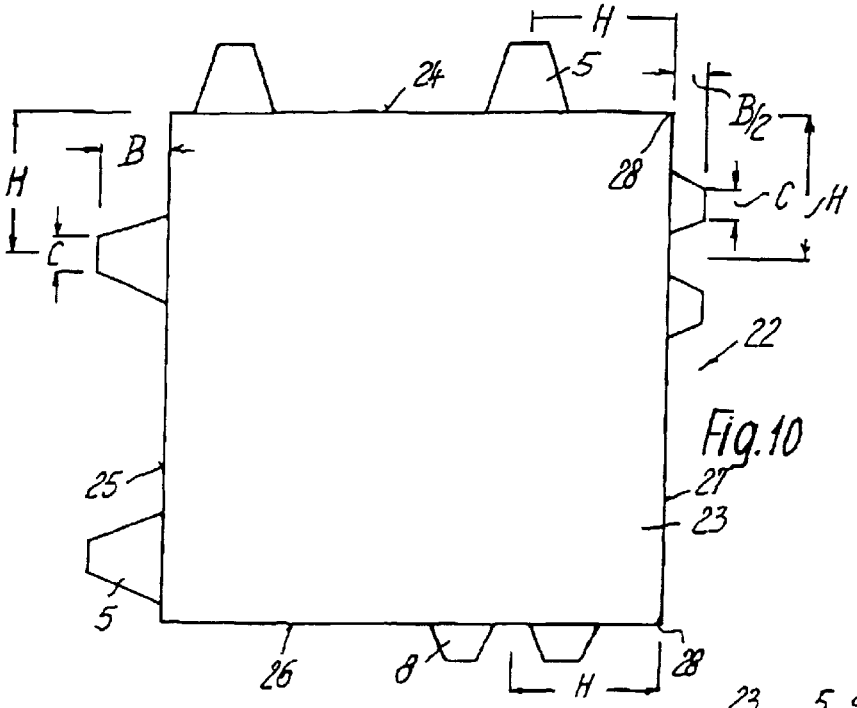
FIG. 10 is a top view of a paving stone with a square shape.
Figure 11:
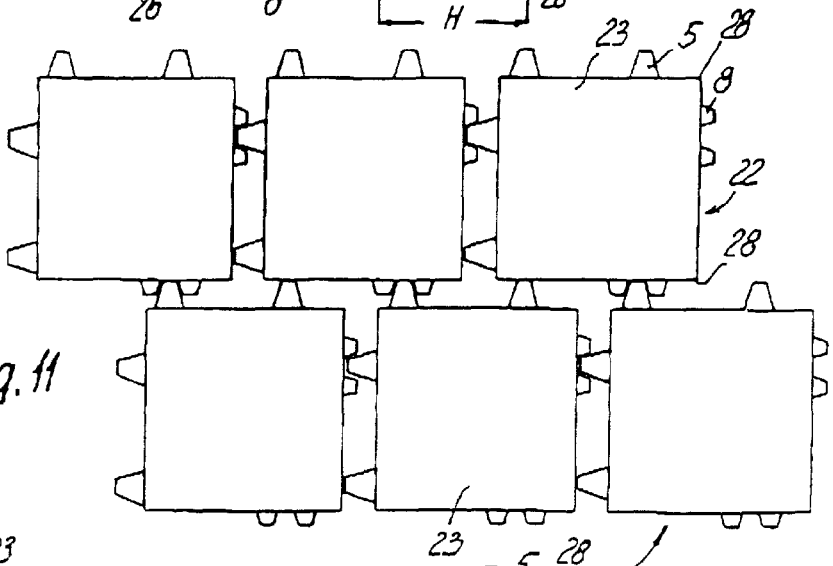
FIG. 11 shows a laying pattern with paving stones according to FIG. 10 viewed from the top in a stretcher-type laying pattern.
Figure 12:
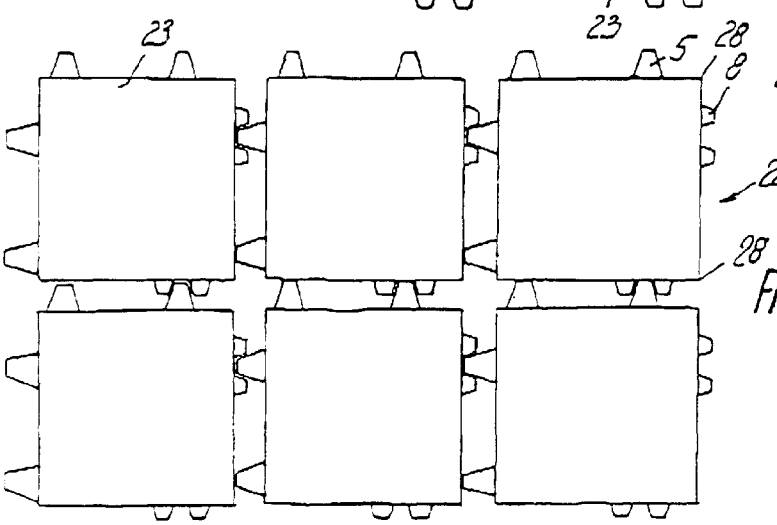
FIG. 12 is a top view of a laying pattern with paving stones according to FIG. 10 in a cross-type laying configuration.

In FIGS. 10 to 12, paving stone 22 has a square paving stone body 23. Lateral surfaces 24 and 25 again hale support attachments 5 with thickness "B" and width "C", and lateral surfaces 26 and 27 have support attachments B with thickness "B/2" and width "C" with center spacing B, displaced relative to corner areas 28. Support attachments and 8 are arranged on lateral surfaces 24 and 25 in such a way that in the composite structure as shown in FIGS. 11 and 12, one support attachment 5 is insertable between support attachments 8 of lateral surfaces 26, 27, whereas the other support attachment 5 in each case is at the same time resting against lateral surface 26, 27 in a supporting manner. Width "C" of support attachments 5 and 8 of FIGS. 10 to 12 is selected to amount to 13 mm, thickness "B" to amount to 27 mm, and thickness "B/2" to amount to about 13 mm. FIG. 11 shows paving stones 22 in a stretcher-type composite layout, and FIG. 12 in a cross-type composite layout.

Figure 13:
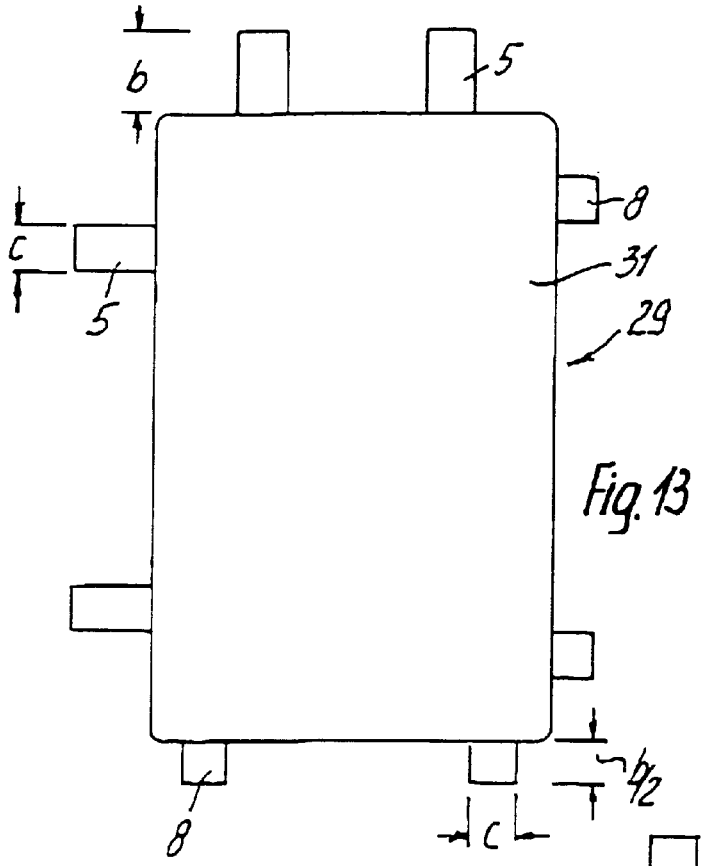
FIG. 13 is a top view of a paving stone with a rectangular shape according to another design.
Figure 14:
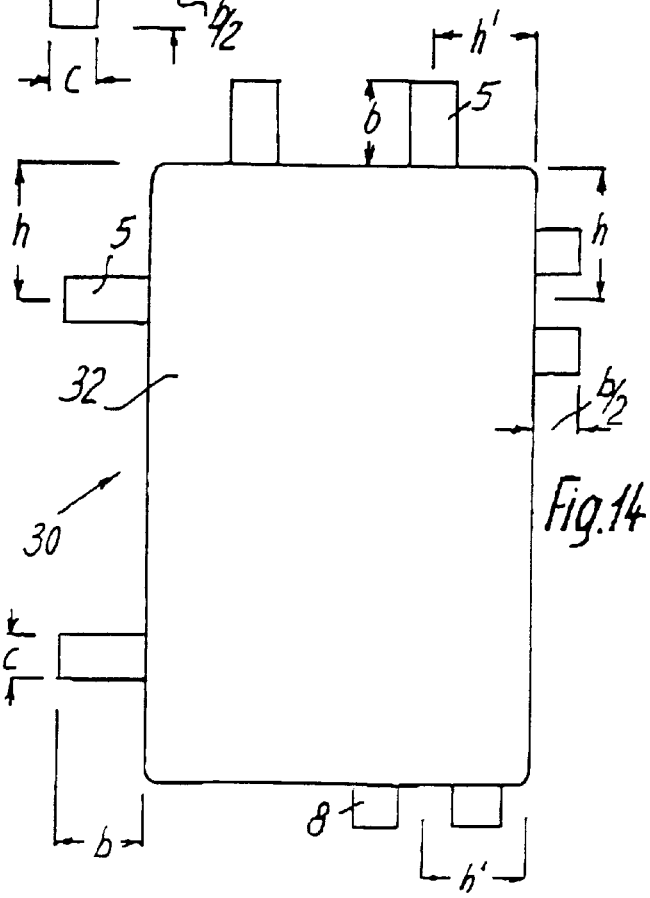
FIG. 14 is a top view of a paving stone with a rectangular shape according to yet another design.

In the exemplified embodiments according to FIGS. 13 and 14, paving stones 29 and 30 are shown with support attachments 5 and 9 on paving stone bodies 31 and 32, respectively, which have the shape of a parallelogram. Support attachment., 5 and 8 are designed with thicknesses "b" and "b/2" and Identical widths "c". In the present embodiments too, in the composite structure, support attachments 5 each engage the intermediate space of support attachments 8 or adjacent paving stones for displacement-free paying, or grip over support attachments 8 of adjacent paving stones installed in a stretcher-type composite pattern.

I claim:

1. A paving stone made of concrete material comprising:

a) a rectangular body having a flat top side, a first set of opposite spaced side surfaces comprising a first side and a third side, said first and third sides each having a first length and a first symmetry line $s^1$ bisecting said first and third sides and a second set of opposite spaced sides comprising a second side and a fourth side having a second length and a second symmetry line $s^2$ bisecting these sides;

b) a first set of trapezoidal shaped support attachments having a width "b" extending out from said first side and said second side surfaces; and c) a second set of trapezoidal shaped support attachments having a width "b/2" extending out from said third side and said fourth side surfaces;

wherein said support attachments are arranged symmetrically on said sides spaced equidistant from said symmetry lines $s^1$ and $s^2$ so that said attachments are butt staggered or butt-jointed with adjacent paving stones so that said support attachments form adjacent side surfaces when said paving stones are placed together.

2. The paving stone according to claim 1, wherein the support attachments have a rectangular shape in the horizontal cross section.

3. A paving stone made of concrete material comprising:

a) a rectangular body having a flat top side, a first set of opposite spaced side surfaces comprising a first side and a third side having a first length and a first symmetry line $s^1$ and a second set of opposite spaced side surfaces comprising a second side and a fourth side having a second length and a second symmetry line $s^2$;

b) a first set of trapezoidal shaped support attachments having a width "b" extending out from said first side and said second side wherein at least one of said support attachments on said first side has a bisecting line H' and at least one of said support attachments on said third side has a bisecting line H; and c) a second set of trapezoidal shaped support attachments having a width "b/2" extending out from said third side and said fourth side;

wherein said first set of trapezoidal shaped support attachments are spaced equidistant from said symmetry lines $s^1$ and $s^2$ on said first and said second sides, and said second set of trapezoidal shaped support attachments are disposed on one side of symmetry lines $s^1$ and $s^2$ and are spaced apart from each other equidistant from symmetry lines H and H' that bisect one of said first set of support attachments, so that when a series of paving stones are stacked together, at least one of said first set of attachments on a first stone insert between said second set of attachments on an adjacent stone.

4. The paving stone according to claim 3, wherein said support attachments have a rectangular shapes in the horizontal cross section.

* * * * *